United States Patent [19]

Moetteli

[11] Patent Number: 4,773,327

[45] Date of Patent: Sep. 27, 1988

[54] INK METERING BLADE

[75] Inventor: John B. Moetteli, Dallas, Tex.

[73] Assignee: AM International, Chicago, Ill.

[21] Appl. No.: 36,874

[22] Filed: Apr. 9, 1987

[51] Int. Cl.[4] ..... B41F 31/04

[52] U.S. Cl. ..... 101/365; 101/169

[58] Field of Search ..... 101/365, 169; 118/261; 15/256.5, 256.51

[56] References Cited

U.S. PATENT DOCUMENTS

| | | | |
|---|---|---|---|
| 980,454 | 1/1911 | Thomson | 101/365 |
| 3,855,927 | 12/1974 | Simeth | 101/365 X |
| 4,485,738 | 12/1984 | Gertsch et al. | 101/365 |
| 4,676,160 | 6/1987 | Linska | 101/365 |

FOREIGN PATENT DOCUMENTS

| | | | |
|---|---|---|---|
| 3100383 | 1/1982 | Fed. Rep. of Germany | 101/365 |
| 3323049 | 3/1984 | Fed. Rep. of Germany | 101/365 |
| 1437974 | 6/1976 | United Kingdom | 101/365 |

*Primary Examiner*—Clifford D. Crowder

*Attorney, Agent, or Firm*—Tarolli, Sundheim & Covell

[57] ABSTRACT

An ink metering blade to control the thickness of an ink film along a fountain roll in a printing press. The blade has a plurality of metering segments which are movable relative to each other by flexing the blade. The flexible construction of the blade is promoted by having slots separating metering segments. The slots are filled by seal members which block a flow of ink through the slots. The seal members are ineffective to transmit force between metering segments of the blade to enable the positions of the metering segments to be accurately adjusted relative to each other. The seal members have a narrow seal section which is disposed in the space between the metering segments and a relatively wide mounting section which is disposed beneath a metering segment. The mounting section may be connected with a metering segment by adhesive. However, a second or backing blade or member may be used to hold the seal members in place.

23 Claims, 3 Drawing Sheets

INK METERING BLADE

BACKGROUND OF THE INVENTION

The present invention relates to a new and improved blade for controlling the thickness of an ink film along a fountain roll in a printing press.

During the printing of newspapers or other publications, one column may require a far greater quantity of ink than an adjacent column. Thus, there may be relatively heavy or dark printing throughout one column of a newspaper and relatively large open or unprinted spaces in an adjacent column of the newspaper. Of course, a substantially greater amount of ink is required to print the dense column than the adjacent open column of the newspaper or other publication.

Printing presses have previously had ink metering assemblies with flexible blades which control the thickness of the ink film along an ink fountain roll. These ink metering assemblies may have a construction similar to that disclosed in U.S. Pat. Nos. 2,283,830; 4,242,958; 4,393,776; 4,495,864; and 4,453,467.

In order to vary the thickness of an ink film transferred to a fountain roll, keys or screws may be operated to flex a metering blade. Operation of an ink fountain key flexes a segment of the metering blade either toward or away from the roll to either decrease or increase the thickness of the film of ink applied to a zone on the roll. Optimization of the thickness of the ink film at various zones or locations along the roll requires that one segment of the blade be flexed relative to an adjacent segment without effecting the position of the adjacent segment.

To minimize the interaction between segments of a metering blade when the blade is flexed to adjust the position of one segment, it has been suggested that the metering blade have a slotted construction similar to that shown in U.S. Pat. No. 4,495,864. In order to prevent leakage of ink through the slots between adjacent segments and to eliminate stickiness between segments, it has been suggested that an elastic rubber-like material be used to seal or close the slots in the manner disclosed in U.S. Pat. No. 3,855,927. In this patent, the elastic rubber-like material is bonded to opposite side surfaces of the slots and to bottom surfaces of segments of the blade.

While the use of an elastic rubber-like seal material in a manner similar to that disclosed in U.S. Pat. No. 3,855,927 will prevent leakage of ink through the slots in the metering blade, this structure does not promote a precise adjustment of the individual segments of the blade relative to each other. This is because the segments are connected to each other by the elastic rubber-like material. Therefore, the position of one segment is changed relative to adjacent segments, forces are transmitted through the elastic rubber-like material between the two segments. Furthermore, continuous shear stresses acting on the elastic rubber-like material tends to cause it to rupture with a resulting requirement to replace the blade after a relatively short period of use. Deterioration of the elastic rubber-like material is promoted by solvents used in cleaning fluids for the rolls of the printing press.

BRIEF SUMMARY OF THE INVENTION

The present invention provides an ink metering blade for controlling the thickness of an ink film along an ink fountain roll. The blade includes a plurality of spaced apart metering segments which are movable relative to each other to vary the thickness of the ink film on the fountain roll. The spaces between the metering segments are sealed to block a flow of ink through the spaces.

In accordance with one feature of the invention, the seal in the spaces between the metering segments is ineffective to transmit force between the metering segments during relative movement between the metering segments. This enables one of the metering segments to be moved relative to adjacent metering segments without transmitting force from the one metering segment to the adjacent metering segments through the seal. Since forces are not transmitted between the metering segments by the seal during adjustment of the blade, the individual metering segments can be accurately adjusted without effecting the position of adjacent segments.

To prevent the transmission of forces between adjacent metering segments, a seal member is connected with one of the metering segments and is freely movable relative to adjacent metering segments when the position of the one metering segment is adjusted. The seal member includes a narrow seal section which is disposed in the space between adjacent metering segments and a mounting section which is connected with a metering segment for movement therewith. In one embodiment of the invention, the seal member is connected with a metering segment by adhesive. In another embodiment of the invention, the blade has a laminated construction and a backing blade or plate presses the seal member against the metering segment. The backing blade may advantageously be formed with individual segments.

Accordingly, it is an object of this invention to provide a new and improved metering blade for controlling the thickness of an ink film along a fountain roll and wherein a seal fills spaces between metering segments to block a flow of ink through the spaces and is ineffective to transmit forces between the metering segments to enable a first metering segment to be moved relative to a second metering segment without effecting the position of the second metering segment.

BRIEF DESCRIPTION OF THE DRAWINGS

The foregoing and other objects and features of the present invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
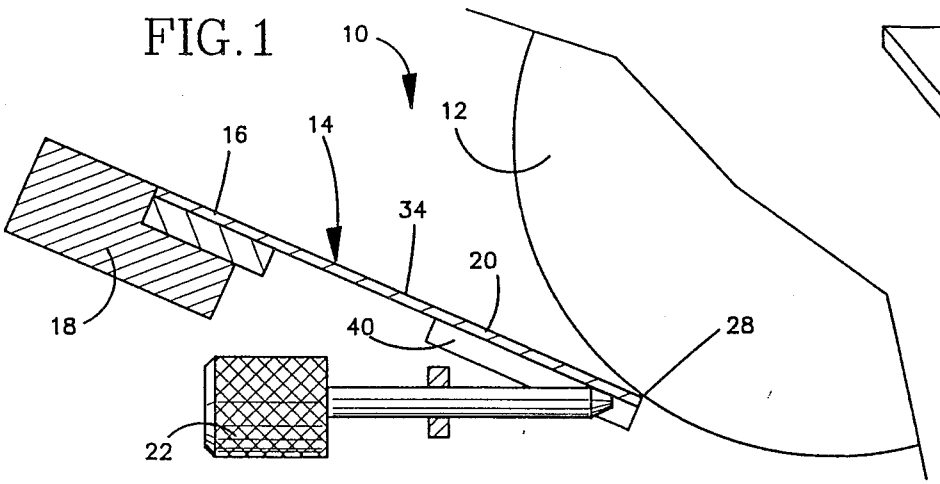
FIG. 1 is a schematic sectional view illustrating the relationship between an ink fountain roll, an ink metering blade, and a key for adjusting the position of a segment of the ink metering blade relative to the ink fountain roll.

An apparatus 10 for controlling the distribution of ink to the blanket cylinders of a printing press is illustrated schematically in FIG. 1. The apparatus 10 includes a cylindrical ink fountain roll 12 and an ink metering blade 14. A mounting end portion 16 of the thin metal 14 is fixedly secured to a support member 18. A metering end portion 20 of the blade 14 is disposed adjacent to the cylindrical outer side surface of the ink fountain roll 12. A plurality of adjusting devices or keys 22, only one of which is shown in FIG. 1, are disposed in a linear array along the blade 14.

Figure 2:
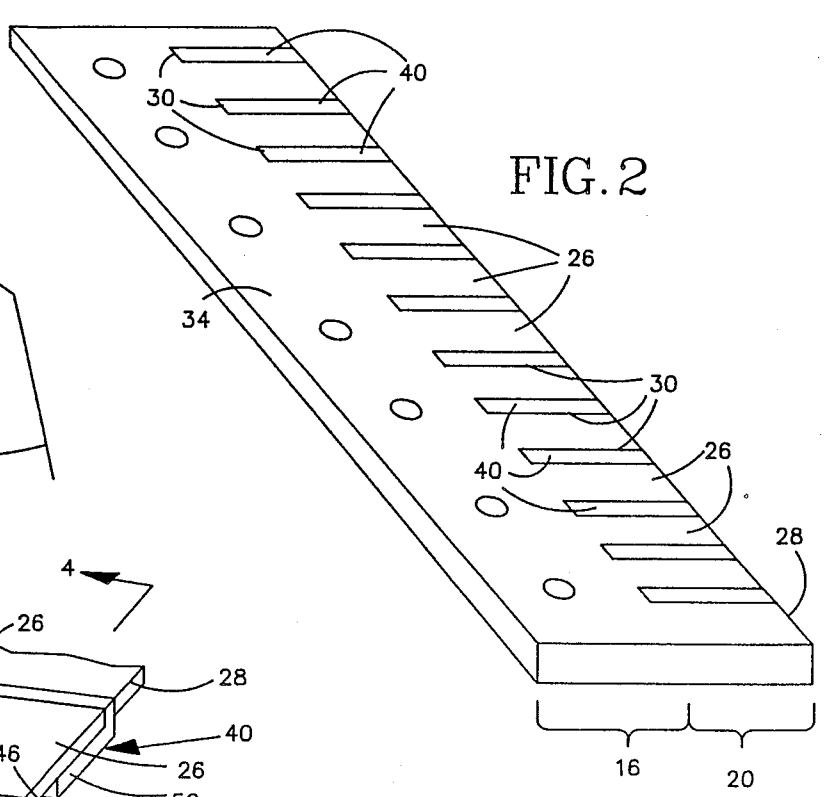
FIG. 2 is a pictorial illustration of an upper side of the ink metering blade of FIG. 1.

In order to vary the thickness of an ink film on the periphery of the fountain roll 12, each of the keys 22 is individually actuatable to flex a metering segment 26 (FIG. 2) of the blade relative to adjacent metering segments. The metering segments 26 cooperate to form a metering edge 28 of the ink fountain blade 14. The metering segments 26 are formed as one piece with the mounting portion 16 and extend perpendicular to a longitudinal central axis of the mounting portion. The metering segments 26 are separated by narrow slots 30 which extend inwardly from the metering edge 28 to the mounting portion 16. The width of the slots 30 has been exaggerated in FIG. 2 for purposes of clarity of illustration.

Each of the ink fountain keys 22 is actuatable to flex one of the metering segments 26 (FIG. 2) toward or away from the ink fountain roll 12 to vary the thickness of the ink film in a cylindrical zone on the roll. Each of the ink fountain keys is actuatable to move one of the metering segments 26 without effecting the position of an adjacent metering segment. This enables each of the metering segments 26 to be individually positioned relative to the ink fountain roll 12 to optimize the configuration of the ink film on the roll.

When the ink film thickness control apparatus 10 is disposed in a printing press which is used to print a newspaper, there is a metering segment 26 and ink fountain key 22 for each column of print to be printed. Therefore, if a column of print is relatively dense and requires a substantial amount of ink to print, the ink fountain key 22 associated with that column of print is actuated to position the associated ink metering segment a relatively large distance from the fountain roll 12. This results in a relatively thick film of ink in this area. Similarly, if a column of print is relatively light, the ink fountain key 22 and metering segment 26 associated with this column of print are actuated to position the metering segment relatively close to the ink fountain roll so that that the film of ink is relatively thin in this zone. Of course, the ink film thickness control apparatus 10 could be used in printing presses other than those used to print newspapers.

Figure 3:
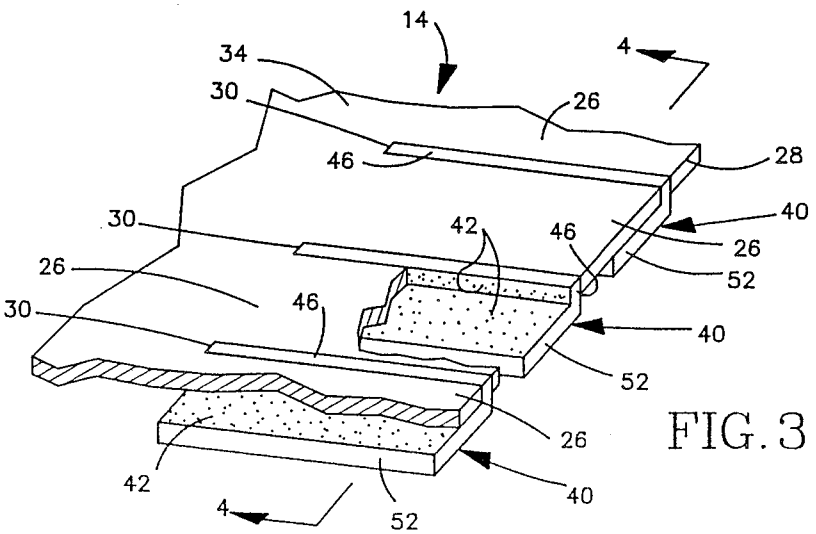
FIG. 3 is a partially broken away fragmentary pictorial view illustrating the relationship between a plurality of seal members and metering segments of the blade of FIG. 2.

During operation of the printing press, a body of ink is disposed on the upper side surface 34 of the ink fountain blade 14. In order to prevent leakage of the ink through the slots 30, the slots are filled by seal members 40 (FIG. 3). The seal members 40 fill the slots 30 to block a flow of ink from the upper side 34 of the blade 14 through the slots. Therefore, the ink is applied to the fountain roll 12 in a film by the metering portion 20 of the blade 14.

In accordance with one of the features of the invention, the seal members 40 are ineffective to transmit force between the metering segments 26 during relative movement between the metering segments. This enables an ink fountain key 22 to be actuated to move a first one of the metering segments 26 relative to adjacent metering segments without force being transmitted from the first metering segment to the adjacent metering segments. Therefore, the position of a selected one of the metering segments 26 can be adjusted relative to the ink fountain roll 12 witnout changing the positions of any of the other metering segments 26 of the blade 14. This enables the thickness of the ink film on the roll 12 to be adjusted at any desired location without altering the thickness of the film at adjacent locations on the roll.

To enable the position of one of the metering segments 26 to be adjusted without changing the position of adjacent metering segments, each of the seal members 40 is connected to a single metering segment 26 for movement therewith. Since each seal member 40 is connected to only one of the metering segments 26, when this metering segment is moved relative to adjacent metering segments, forces are not transmitted between metering segments. This enables the individual metering segments 26 to be adjusted without effecting the positions of adjacent metering segments.

SEAL MEMBER—EMBODIMENT OF FIGS. 3 AND 4

Figure 4:
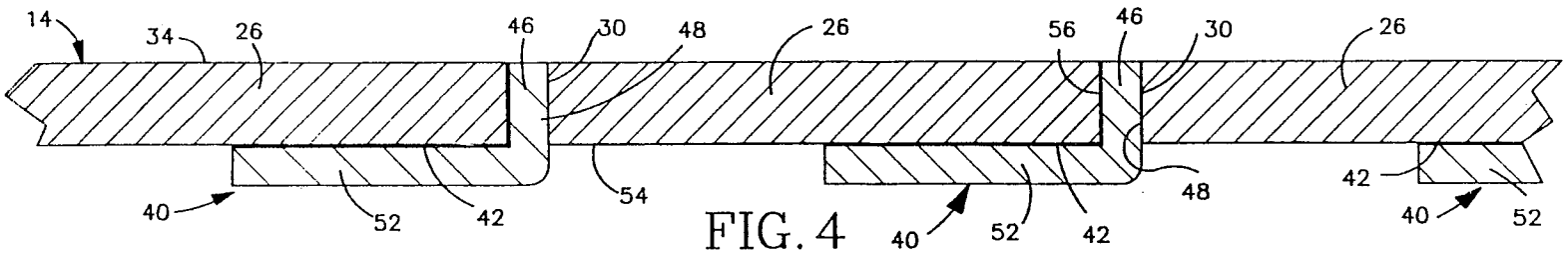
FIG. 4 is a fragmentary sectional view, taken generally along the line 4—4 of FIG. 3, and illustrating a generally L-shaped cross sectional configuration of the seal members.

In the embodiment of the invention illustrated in FIGS. 3 and 4, the seal members 40 are connected with the metering segments 26 by layers 42 of adhesive. Each layer 42 of adhesive fixedly connects one seal member 40 to one and only one of the metering segments 26. This enables any one of the seal members 40 and metering segments 26 to be moved together relative to adjacent metering segments without transmitting forces between the metering segments. Although it is preferred to use the adhesive 42 to connect the seal members 40 with the metering segments 26, the metering segment and seal member could be fixedly connected in other known ways, such as with rivets or with other mechanical fasteners, brazing, spot welding, or interlocking surfaces.

The seal members 40 perform the dual functions of blocking a flow of ink through the slots 30 and enabling the metering segment 26 to be freely moved relative to each other without transmitting force from one metering segment to another metering segment. Each of the seal members 40 has a generally L-shaped configuration. A short leg or seal section 46 of each L-shaped seal member 40 extends into a slot 30 and fills the slot (FIG. 4).

The short leg 46 of an L-shaped seal member 40 (FIG. 4) is relatively narrow in a direction measured parallel to the flat upper side surface 34 of the blade 14. However, the width of the narrow seal section 46 is sufficient to fill the slot 30 to block a flow of ink through the slot. Although the seal section 46 fills the slot 30 between a pair of metering segments 26, there is sufficient clearance to enable relative movement to freely occur between the metering segments 26.

Upon upward (as viewed in FIG. 4) movement of the central metering segment 26, the attached seal member 40 moves upwardly while the adjacent metering segments remain stationary. As this occurs, the seal section 46 slides upwardly along a minor side surface 48 on the adjacent stationary metering segment 26 which is disposed to the right (as viewed in FIG. 4) of the seal member. At the same time, a left (as viewed in FIG. 4) minor side surface 48 on the central metering segment 26 slides upwardly along a stationary seal member 40 which is connected to the left (as viewed in FIG. 4) adjacent metering segment 26.

Although the seal section 46 connected with the central metering segment 26 of FIG. 4 moves upwardly relative to the right metering segment, there is no force transmitted between the two metering segments. This is because there is a very slight clearance between the minor side surface 48 of the right metering segment 26 (as viewed in FIG. 4) and the seal section 46. This clearance space is small enough to prevent the leakage of ink from the upper side surface 34 of the blade 14 through the slot 30. However, the clearance space is sufficient to prevent the transmittal of force from the central metering segment 26 to the right metering segment as the central metering segment is moved by actuation of its associated ink fountain key 22.

Similarly, there is a very slight clearance between the left minor side surface 48 of the central metering segment 26 of FIG. 4 and the seal member 40 connected to the adjacent metering segment. This clearance space is small enough to prevent leakage of ink from the upper side surface 34 of the blade 14 through the slot 30. However, the clerance space is sufficient to prevent the transmittal of force from the central metering segment 26 to the left metering segment as the central metering segment is moved by actuation of its associated ink fountain key 22.

The seal member 40 of FIG. 4 has a relatively long leg or mounting section 52 which is connected to a lower major side surface 54 of the metering segment 26. The relatively wide mounting section 52 is secured to the bottom surface 54 of the metering segment 26 by the layer 42 of adhesive. The layer 42 of adhesive also connects the seal section 46 to a minor side surface 56 of the metering segment 26. Thus, in the illustrated embodiment of the invention, the seal member 40 is connected to the metering segment 26 by adhesive between the mounting section 52 and lower side surface 54 of the metering segment 26 and by adhesive between the seal section 46 and minor side surface 56 of the metering segment 26.

If desired, the adhesive layer 42 could be omitted between one of the sections of the seal member 40 and the metering segment 26. For example, the adhesive could be omitted between the seal section 46 and the minor side surface 56 of the metering segment 26, or the adhesive could be omitted between the mounting section 52 and the major side surface 54 of the metering segment. Other known types of fasteners could be used if desired. In any case, the seal member 40 is connected to only one of the metering segments 26 for movement therewith relative to the adjacent metering segments without transmitting force between the metering segments.

The seal members 40 are advantageously made of metal, preferably stainless steel. This material is resistent to the solvents used in cleaning fluids for the rolls of printing presses. However, the seal members 40 could be formed of other known materials, such as a polymeric material.

In one specific preferred embodiment of the invention, the seal members were formed of a commericallay available stainless tape obtained from Teledyne Sterling Hunt Co. This specific stainless steel tape had a thickness of 0.005 inches and a width of three inches. It should be understood that the foregoing specific example of construction of the seal members 40 has been set forth for purposes of clarity of illustration and not for limitation of the invention.

SEAL MEMBER—EMBODIMENT OF FIG. 5

Figure 5:
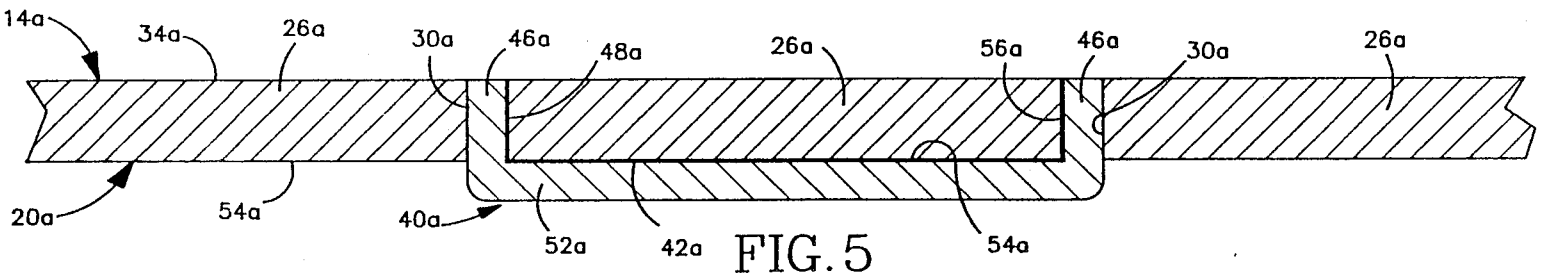
FIG. 5 is a fragmentary sectional view of a second embodiment of the metering blade in which the seal members have a generally U-shaped cross sectional configuration.

In the embodiment of the invention illustrated in FIGS. 3 and 4, each seal member 40 fills only a single slot 30 to block the flow of ink through that slot. In the embodiment of the invention illustrated in FIG. 5, a single seal member is used to fill two slots and blocks the flow of ink through both of the slots. Since the embodiment of the invention illustrated in FIG. 5 is generally similar to the embodiment of the invention illustrated in FIG. 4, similar numerals will be utilized to designate similar components, the suffix letter "a" being associated with the numerals of FIG. 5 to avoid confusion.

An ink metering blade **14*a* has a metering portion 20*a* with a plurality of narrow slots 30*a* which extend inwardly from a metering edge of the blade. In accordance with a feature of this embodiment of the invention, a single seal member 40*a* fills the slots 30*a* on opposite sides of a central metering segment 26*a* to block a flow of ink through the slots and to enable the central metering segment 26*a*** to be moved relative to adjacent metering segments without transmitting force between the central metering segment and the adjacent metering segments.

The seal member **40*a* has a generally U-shaped cross sectional configuration. A pair of narrow seal sections 46*a* extend upwardly from a relatively wide mounting section 52*a*. The seal sections 46*a* fill the slots 30*a* to block a flow of ink through the slots. The relatively wide mounting section 52*a* spans the width of the central mounting section 26*a***.

The seal member **40*a* is connected to the central mounting section 26*a* by a layer 42*a* of adhesive. The adhesive layer 42*a* connects the seal section 46*a* with a minor side surface 56*a* of the metering segment 26*a*. Similarly, the adhesive layer 42a connects the opposite seal section 46*a* with the minor side 48*a* of the metering segment 26*a*. In addition, the adhesive 42*a* connects mounting section 52*a* of the seal member 40*a* with the lower major side surface 54*a* of the metering segment 26*a***.

The seal member 40a is secured to only the central metering segment 26a. Therefore, upon operation of an ink fountain key to deflect the blade 14a to move the central metering segment 26a, the seal member 40a moves relative to the two adjacent metering segments 26a. An extremely small clearance space is provided between each of the seal sections 46a and the adjacent metering segments 26a to enable relative movement to occur between the metering segments without transmitting forces between the metering segments. It should be understood that although it is preferred to use the adhesive layer 42a to connect the seal member 40a with the central (as viewed in FIG. 5) metering segment 26a, other types of fastening devices could be used if desired.

The seal member 40a of FIG. 5 is connected with its associated metering segment 26a by adhesive. Although the seal member 40a could be formed from sheet material and coated with adhesive before being connected with the blade 14a, it is preferred to have the seal member 40a formed of a metal tape. While the seal member 40a could be formed of many different types of tape, in one specific preferred embodiment of the invention, the seal member 40a was formed of a stainless steel tape having a thickness of 0.005 inches and having a width of three inches.

It should be understood that although it is preferred to form the seal member 40a from a metal tape, the seal member could be formed of many different materials, such as nylon or other polymeric materials. Although it is preferred to have both the seal sections 46a and mounting section 52a of the seal member 40a secured to a metering segment 26a, it may be preferred to use adhesive in conjunction with only one of these sections, such as the mounting section 52a. Although only one seal member 40a has been shown in FIG. 5 attached to one metering segment 26a, seal members 40a are connected to every second metering segment 26a along the blade 14a.

Figure 6:
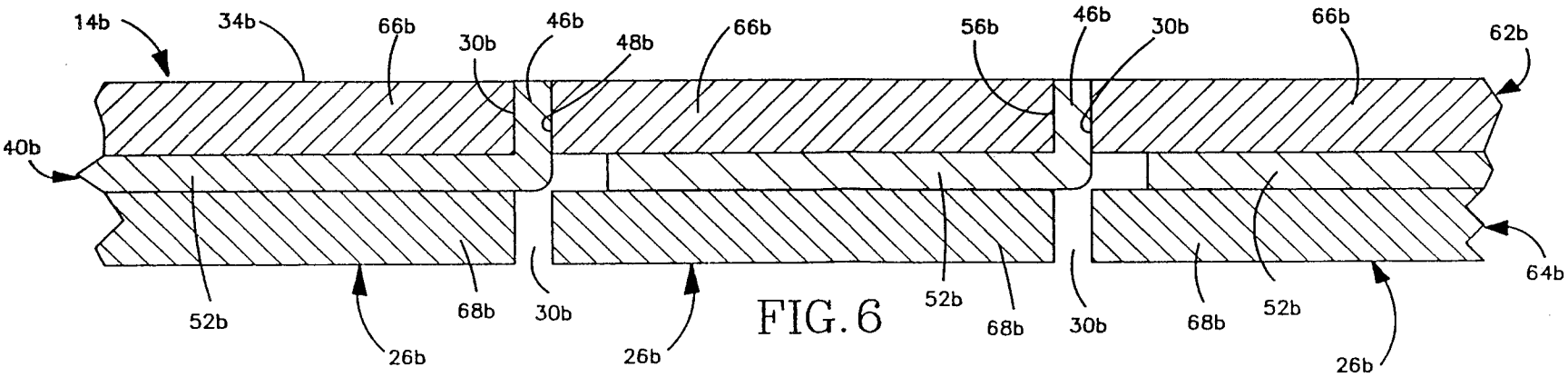
FIG. 6 is a fragmentary cross sectional view of a laminated embodiment of the blade in which the seal members are pressed against an upper blade member by a segmented backing layer or blade.

Laminated Blade—Embodiment of FIG. 6

In the embodiment of the invention illustrated in FIGS. 3–5, the metering blade has been formed as a single layer with each of the seal members fixedly connected to the layer. In the embodiment of the invention illustrated in FIG. 6, the ink metering blade has an upper or main layer and a lower or backing layer. Since the embodiment of the invention illustrated in FIG. 6 is generally similar to the embodiment of the invention illustrated in FIGS. 3–5, similar numerals will be utilized to identify similar components, the suffix letter "b" being associated with the numerals of FIG. 6 to avoid confusion.

The blade 14b (FIG. 6) has a laminated construction with an upper or main layer 62b and a lower or backing layer 64b. The upper and lower layers 62b and 64b of the blade 14b have the same configuration. Thus, both layers 62b and 64b have a mounting portion which is fixedly connected with a suitable support and a segmented metering portion corresponding to the mounting and metering portions 16 and 20 (FIG. 2) of the blade 14.

Slots 30b extend inwardly from the metering edge of the laminated blade 14b to the mounting portion of the blade. The narrow slots 30b are formed in both the upper and lower layers 62b and 64b to form laminated metering segments 26b. Seal members 40b fill the slots 30b to block the flow of ink from an upper side 34b of the blade through the slots.

The laminated metering segments 26b each include a segment 66b in the upper layer 62b and a segment 68b in the lower layer 64b. The upper and lower segments 66b and 68b are vertically aligned and are spaced to hold a seal member 40b.

To enable a segment 66b of the upper layer 62b and a vertically aligned segment 68b in the lower layer 64b to be moved together by an ink fountain key without influencing the positions of adjacent segments, the seal members 40b are ineffective to transmit force between adjacent metering segments 26b of the blade 14b. Thus, upon actuation of the ink fountain key associated with the central metering segment 26b of FIG. 6, a pair of vertically aligned segments 66b and 68b in the upper and lower layers 62b and 64b are moved while the adjacent metering segments 26b on opposite sides of the central metering segment remain stationary.

In accordance with a feature of this embodiment of the invention, the seal members 40b are clamped between the upper and lower layers 62b and 64b of the blade 14b. By clamping the mounting sections 52b of the seal members 40b between the segments 66b and 68b in the upper and lower layers 62b and 64b, the need for an additional connection between the seal members 40b and the upper and lower layers is eliminated. Thus, there is no adhesive between the seal members 40b and the metering segments 26b. Of course, layers of adhesive, corresponding to the adhesive layer 42 of FIG. 4, could be provided between the seal members 40b and the segments 66b of the upper layer 62b, or between the seal members and the segments 68b of the lower layer 64b, or between the seal members and the segments of both the upper and lower layers 62b and 64b.

Figure 7:
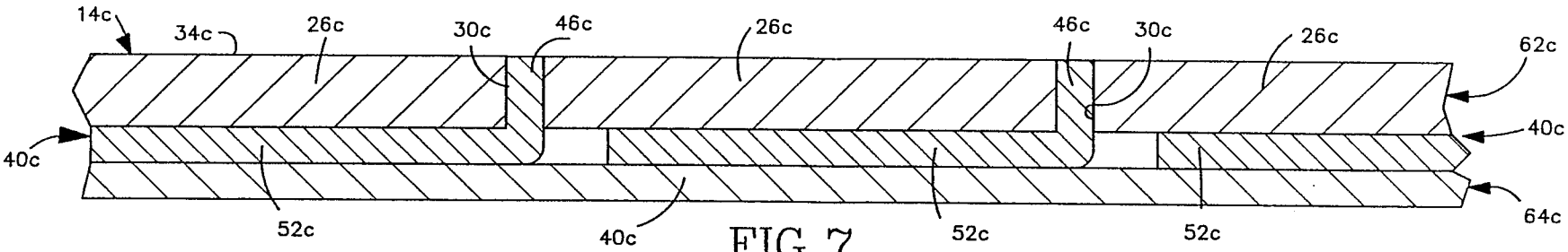
FIG. 7 is a fragmentary sectional view of a laminated embodiment of the blade in which the seal members are pressed against an upper blade member by a nonsegmented backing layer or blade.

Laminated Blade—Embodiments of FIG. 7

In the embodiment of the laminated blade 14b of FIG. 6, the lower layer 64 has the same configuration as the upper layer 62. Thus, the slots 30b extend through both the upper and lower layers. In the embodiment of the invention shown in FIG. 7, the lower layer is formed by a backing plate which does not have slots corresponding to the slots in the upper layer. Since the embodiment of the invention illustrated in FIG. 7 is generally similar to the embodiment of the invention illustrated in FIG. 6, similar numerals will be utilized to identify similar components, the suffix letter "c" being associated with FIG. 7 to avoid confusion.

The blade 14c has a main or upper layer 62c and a lower or backing layer 64c. A plurality of seal members 40c fill slots 30c in the upper layer 62c to block a flow of ink from the upper side of the upper layer 62c through the blade. The seal members 40c are ineffective to transmit force between metering segments 26c of the blade 14c when ink fountain key is adjusted to move one of the metering segments relative to the adjacent metering segment.

A relatively thin backing plate 64c holds the mounting sections 52c of the seal members 40c in firm abutting engagement with the metering segment 26c. Upon actuation of an ink fountain key, the metal bottom layer 64c is flexed at a location beneath one of the segments 26c of the metal upper layer 62c. This results in movement of this one metering segment 26c and its associated seal member 40c relative to the adjacent metering segments.

Although it is preferred to rely on only the backing plate 64c to hold the seal members 40c in engagement with the metering segment 26c, a layer of adhesive could be provided between the metering segments and the seal members, if desired. This will result in the seal members 40c being connected with the metering segments 26c by the adhesive in much the same manner as in which the seal members 40 of FIG. 4 are connected with the metering segments 26 by the adhesive 42.

Figure 8:
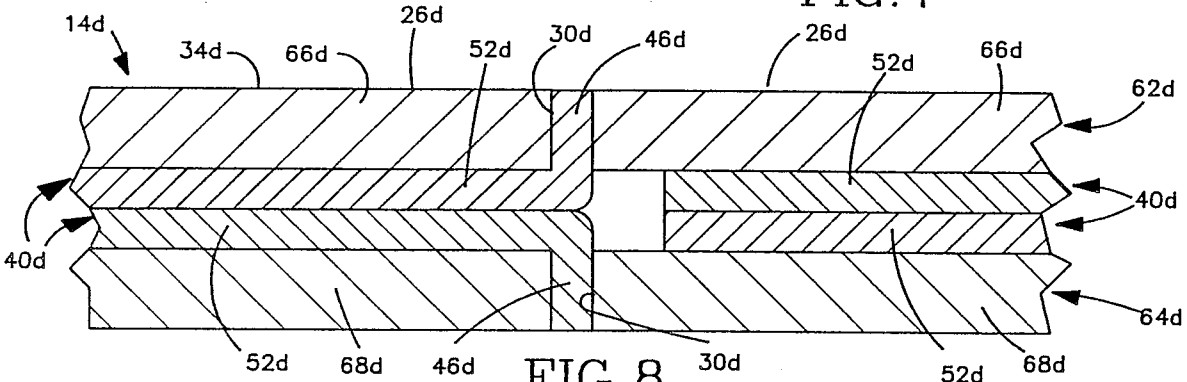
FIG. 8 is a fragmentary sectional view of a laminated embodiment of the blade in which a pair of L-shaped seal members cooperate with segments of a pair of blade members.

Laminated Blade—Embodiment of FIG. 8

In the embodiment of the laminated blade illustrated in FIG. 6, only a single seal member 40b is provided in each laminated metering segment. In the embodiment of the invention illustrated in FIG. 8, a pair of seal members are provided in each laminated metering segment. Since the embodiment of the invention illustrated in FIG. 8 is generally similar to the embodiment of the invention illustrated in FIG. 6, similar numerals will be utilized to designate similar components, the suffix letter "d" being associated with the numerals of FIG. 8 to avoid confusion.

The laminated blade 14d has a segmented upper or main layer 62d and a segmented lower or backing layer 64d with the same configuration as the upper layer. Slots 30d extend from the metering edge of the blade 14d to the mounting portion of the blade to form a plurality of laminated metering segments 26d. The laminated metering segments 26d are formed of segments 66d and 68d in the metal upper and lower layers 62d and 64d.

In accordance with a feature of this embodiment of the invention, a pair of seal members 40d is provided in each laminated metering segment 26d. The upper seal member 40d has a narrow seal section 46d which extends into a narrow slot 30d between adjacent segments 66d in the upper layer 62d. Similarly, a lower seal member 40d has a seal section 46d which extends into a narrow slot 30d between adjacent segments 68d in the lower layer 64d. The seal sections 46d on the seal members 40d fill the slots 30d between adjacent metering segments 26d of the blade 14d to block a flow of ink through the slots. The seal members 40d are ineffective to transmit force between adjacent metering segments 26d of the blade 14d during relative movement between the metering segments. This enables one of the metering segments 26d to be adjusted relative to the adjacent metering segment without force being transmitted between the metering segments.

The seal members 40d have relatively wide mounting sections 52d which are disposed in abutting engagement with each other and with major side surfaces of the metering segments 26d of the upper and lower layers 62d and 64d of the laminated blade 14d. The two seal members 40d are clamped in place between the metering segments 26d of the upper and lower layers 62d and 64d and move with these metering segments relative to the adjacent metering segments when the blade is adjusted. In the embodiment of the invention illustrated in FIG. 8, it is preferred to merely have the seal members 40d abut the major side surfaces of the segments 66d and 68d and to abut each other without providing adhesive between the abutting surfaces. However, it is contemplated that adhesive could be provided between the surfaces of the segments 66d and 68d and the abutting surfaces of the seal members 40d. If desired, adhesive could be provided between abutting surfaces of the seal members 40d themselves. Of course, the seal members 40d could be connected with the segments 66d and 68d in the upper and lower layers 62d and 64d by other types of connections, such as mechanical fasteners.

Figure 9:
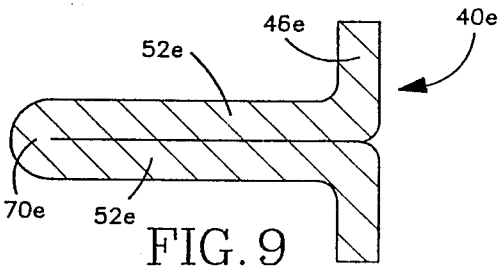
FIG. 9 is a sectional view of a one-piece seal member wnich cooperates with segments of a pair of blade members in a manner similar to that illustrated in FIG. 8.

Seal Member—Embodiment of FIG. 9

In the embodiment of the invention illustrated in FIG. 8, two separate seal members 40d are provided between vertically aligned segments 66d and 68d of the upper and lower layers 62d and 64d of the laminated blade 14d. However, it is contemplated that the two seal members could be formed as one piece, in the manner illustrated in FIG. 9. Since the embodiment of the invention illstrated in FIG. 9 is generally similar to the embodiment of the invention illustrated in FIG. 8, similar numerals will be utilized to designate similar components, the suffix letter "e" being associated with FIG. 9 to avoid confusion.

A seal member 40e has upwardly and downwardly projecting seal sections 40e which fill narrow slots or spaces between segments of upper and lower layers of a laminated blade, in the same manner as in which the slots 30d of FIG. 8 are filled by the seal sections 46d on the two seal members 40d.

In accordance with a feature of the embodiment of the invention illustrated in FIG. 9, the seal memer 40e is formed as one piece. The seal member 40e has a pair of relatively wide mounting sections 54e which are interconnected by an arcuate bight or center section 70e.

The one piece seal member 40e is, in the illustrated embodiment of the invention, made of stainless steel and has a thickness of approximately 0.005 inches. Although it is preferred to merely form the seal member from stainless steel sheet material, the seal member could be formed from stainless steel tape, if desired. If the seal member 40e was formed of stainless steel tape, it would have adhesive along the upwardly facing side surface of the upper mounting section 52e and the downwardly facing side surface of the lower mounting section. In addition, the leftwardly facing (as viewed in FIG. 9) side surfaces of the seal sections 46e would be covered with adhesive.

It is preferred to clamp the seal member 40e in place between upper and lower layers of a laminated ink metering blade without using adhesive. Of course, mechanical fasteners could be used to interconnect the upper and lower layers of the ink metering blade. These mechanical fasteners could extend through the seal member 40e to securely lock it in place.

Figure 10:
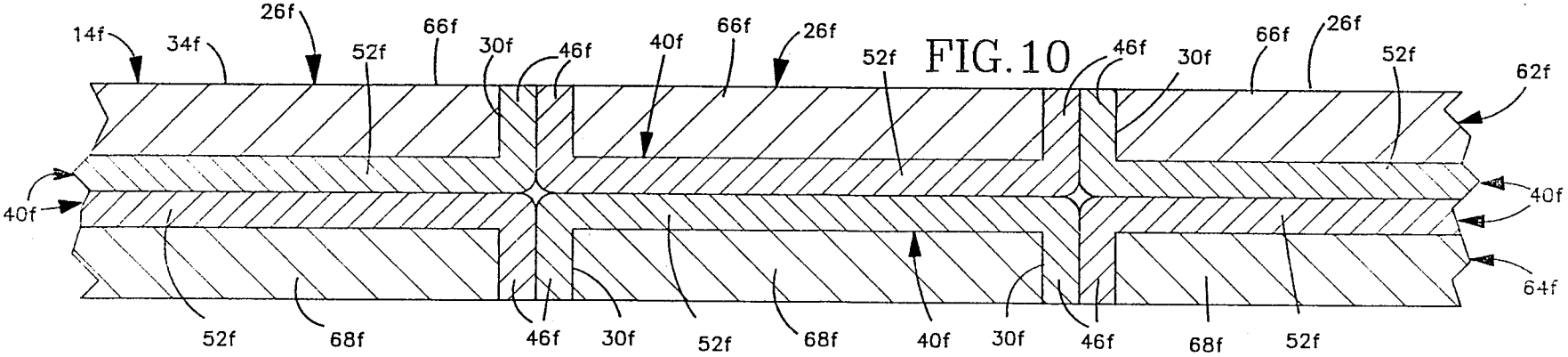
FIG. 10 is an illustration of an embodiment of the blade in which a pair of generally U-shaped seal members are provided between segments of upper and lower blade members.

Laminated Blade—Embodiment of FIG. 10

In the embodiments of the laminated blade illustrated in FIGS. 6, 7 and 8, generally L-shaped seal members 40b, 40c, and 40d are provided between the upper and lower layers of the blade. In the embodiment of the invention illustrated in FIG. 10, seal members having a generally U-shaped configuration are provided between upper and lower layers of the laminated blade. The seal members of FIG. 10 have the same general construction as the seal member of FIG. 5 and cooperate with the upper and lower layers of the laminated blade in the same general manner as in the embodiment of the invention illustrated in FIG. 8. Therefore, similar numerals will be utilized to designate similar components, the suffix letter "f" being associated with the embodiment of FIG. 10 to avoid confusion.

The laminated blade 14f has metal upper and lower layers 62f and 64f. Slots 30f extend from the metering edge of the blade 14f to the mounting section to form a plurality of laminated metering segments 26f. Generally U-shaped seal members 40f fill the slots 30f between the metering segments 26f of the laminated ink metering blade 14*f*. The seal members 40*f* block a flow of ink through the slots 30*f*. However, the seal members 40*f* are ineffective to transmit force between metering segments 26*f* when vertically aligned upper and lower segments 66*f* and 68*f* are moved relative to adjacent segments to adjust the blade. This enables one laminated metering segment 26*f* to be moved relative to the adjacent metering segments without changing the positions of the adjacent metering segments.

The seal members 40*f* have a pair of narrow seal sections 46*f*. The seal sections 46*f* at opposite ends of each of the seal members 40*f* are interconnected by a generally horizontally extending mounting section 52*f*. The mounting sections 52*f* of a pair of vertically aligned seal members 40*f* are disposed between metering segments 66*f* and 68*f* of the upper and lower layers 62*f* and 64*f*. These mounting sections 52*f* are disposed in flat abutting engagement.

In this embodiment of the invention, the seal sections 46*f* on a pair of vertically aligned seal members 40*f* in one metering segment 26*f* slide along seal sections 46*f* on seal members 40*f* in adjacent metering segments 26*f* during adjusting movement of the blade 14*f*. Thus, the central laminated metering segment 26*f* of FIG. 10 has seal sections 46*f* which slide on seal sections 46*f* of seal members 40*f* in the left and right adjacent laminated metering segments 26*f*. The seal members 40*f* are formed of stainless steel so that there is little or no friction between the seal members. In addition, if desired, a very small clearance space could be provided between seal sections 46*f* of a pair of seal members disposed in one of the slots 30*f* to further facilitate relative movement between the metering segments 26*f* without transmitting force between the metering segments. Of course, the seal members 40 could be formed of other materials if desired.

Seal Members—Method of Mounting

The seal members 40, 40*a*, 40*b*, 4*c*, 40*d*, 40*e*, and 40*f* are all advantageously made from rather thin pieces of sheet material. The sheet material may be any one of many different tapes having an adhesive layer to secure the seal members with segments of a blade. However, the seal members can also be formed of plain sheet material and mechanically held in place by either gripping the seal members between upper and lower layers of a laminated blade or using mechanical or other fastener elements. The seal members are formed from stainless steel sheet material which does not deteriorate when exposed to the solvents used in printing press cleaning fluids. Of course, the seal members could be formed of other materials, if desired.

Regardless of the specific construction of the seal members, it is necessary for the upper side surface of an ink metering blade to be smooth. Thus, the seal sections 46, 46*a*, 46*b*, 46*c*, 46*d*, 46*e*, and 46*f* of the seal members 40–40*f* cannot project above the upper side surface of the blade. If the seal sections 46–46*f* did project above the upper side surface of the blade, they would press against the ink fountain roll 12 (FIG. 1) and form grooves in the ink film on the ink fountain roll. Similarly, if the seal sections 46–46*f* are not even with the upper side surface of a blade, but are recessed below the upper side surface of the blade, ridges or projections would be formed in the ink film on the roll 12.

In order to make the ink metering blades 14–14*f* with a smooth upper side surface in which the seal sections of the seal members are even with the upper side surfaces of the metering segments 26–26*f*, the blades are initially formed with the seal sections projecting upwardly from the upper sides of the blades. A sharp cutting edge is then moved along the surface of the blade to cut off the projecting portions of the seal section. This results in the blade being formed with a smooth continuous upper side surface.

When the ink metering blade 14 of FIG. 4 is being fabricated, the seal members 40 are secured in place by engaging the metering segments 26 with the adhesive 42. The seal sections 46 are slightly longer than illustrated in FIG. 4 so that they project upwardly above the upper side surface 34 of the blade 14. A sharp cutting edge is then moved along the upper side surface 34 of the blade to cut off the projecting portion of the seal sections 46 at the upper side surface 34 of the blade. This results in the blade having a smooth continuous upper side surface which extends between the metering segments 26 when the blade is in a relaxed or undeflected condition.

Although only the manner in which the upper side surface 34 of a blade is made smooth has been described, it should be understood that the metering edge 28 can be trimmed in a similar manner. Thus, the blade is initially formed with the seal members 40 extending outwardly from the metering edge 28. A sharp cutting edge is then moved along the metering edge to cut off the projecting portions of the seal members 40.

Conclusion

The present invention provides an ink metering blade 14 for controlling the thickness of an ink film along an ink fountain roll 12. The blade 14 includes a plurality of spaced apart metering segments which are movable relative to each other to vary the thickness of the ink film on the fountain roll. The spaces or slots 30 between the metering segments 26 are sealed to block a flow of ink through the spaces.

In accordance with a feature of the invention, the seal in the spaces or slots 30 between the metering segments 26 is ineffective to transmit force between the metering segments 26 of the blade 14 during relative movement between the metering segments. This enables one of the metering segments 26 to be moved relative to adjacent metering segments without transmitting force from the one metering segment to the adjacent metering segments through the seal. Since forces are not transmitted between the metering segments by the seal during adjustment of the blade 14, the individual metering segments 26 can be accurately adjusted without effecting the position of adjacent segments.

To prevent the transmission of forces between adjacent metering segments 26, a seal member 40 is connected with one of the metering segments 26 and is freely movable relative to adjacent metering segements when the position of the one metering segment is adjusted. The seal member 40 includes a narrow seal section 46 which is disposed in the space 30 between adjacent metering segments 26 and a mounting section 52 which is connected with a metering segment 26 for movement therewith. In one embodiment of the invention, the seal member 40 is connected with a metering segment by adhesive 42. In other embodiments of the invention (FIGS. 6, 7, 8 and 10), the blade has a laminated construction and a backing blade or layer (64*b*, 64*c*, 64*d* or 64*f*) presses the seal member against the metering segment. The backing layer may advantageously be formed with individual segments.

Having described specific preferred embodiments of the invention, the following is claimed:

1. An ink metering blade for controlling the thickness of an ink film along an ink fountain roll, said metering blade comprising a blade member having a longitudinally extending mounting portion and a plurality of spaced apart metering segments which extend outwardly from said mounting portion in a direction transverse to the longitudinal axis of said mounting portion and are moved relative to each other to vary the thickness of the ink film, and seal means filling the spaces between said metering segments to block a flow of ink through the spaces, said seal means being ineffective to transmit force between said metering segments of said blade member during relative movement between said metering segments of said blade member to enable a first one of said metering segments to be moved relative to a second one of said metering segments without force from said first metering segment being transmitted to said second metering segment through said seal means, said seal means including a seal member having a narrow seal section disposed in the space between said first and second metering segments and a wide mounting section connected with said first metering segment for movement therewith.

2. An ink metering blade as set forth in claim 1 wherein said seal means further includes adhesive means disposed between said wide mounting section of said seal member and said first metering segment to interconnect said seal member and said first metering segment.

3. An ink metering blade as set forth in claim 1 wherein said seal means further includes adhesive means disposed between said narrow seal section of said seal member and said first metering segment to interconnect said seal member and said first metering segment.

4. An ink metering blade as set forth in claim 1 wherein said wide mounting section of said seal member includes first and second side surfaces, said metering blade including means for applying force against said first side surface of said mounting section to hold said second side surface of said mounting section in abutting engagement with a side surface of said first metering segment.

5. An ink metering blade as set forth in claim 4 wherein said metering segments are disposed in a longitudinally extending array, said means for applying force against said first side surface of said mounting section of said seal member includes an elongated plate member which extends along the length of the array of metering segments.

6. An ink metering blade as set forth in claim 1 wherein said seal member has a second narrow seal section disposed in a space between a third one of said metering segments and said first metering segment, said narrow seal sections being formed as one piece with said wide mounting section.

7. An ink metering blade as set forth in claim 6 further including a backing plate means connected with said blade member for holding said seal members against movement relative to said blade member.

8. An ink metering blade as set forth in claim 6 further including first and second connector means for connecting said narrow seal sections of said seal member with said first metering segment.

9. An ink metering blade for controlling the thickness of an ink film along an ink fountain roll, said metering blade comprising a blade member having a longitudinally extending mounting portion and a plurality of spaced apart metering segments which extend outwardly from said mounting portion in a direction transverse to the longitudinal axis of said mounting portion and are moved relative to each other to vary the thickness of the ink film, and seal means filling the spaces between said metering segments to block a flow of ink through the spaces, said seal means being ineffective to transmit force between said metering segments of said blade member during realative movement between said metering segments of said blade member to enable a first one of said metering segments to be moved relative to a second one of said metering segments without force from said first metering segment being transmitted to said second metering segment through said seal means, said ink metering blade further including a second blade member having a longitudinally extending mounting portion and a plurality of spaced apart metering segments which extend outwardly from said mounting portion of said second blade member in a direction transverse to the longitudinal axis of said mounting portion of said second blade member and are movable relative to each other, said seal means blocking a flow of ink through the spaces between said metering segments of said second blade member, said seal means being ineffective to transmit force between said metering segments of said second blade member during relative movement between metering segments of said second blade member to enable a first one of said metering segments of said second blade member to be moved relative to a second one of said metering segments of said second blade member without force from said first metering segment of said second blade member being transmitted to said second metering segment of said second blade member through said seal means.

10. An ink metering blade as set forth in claim 9 wherein said seal means includes a seal member connected with said first metering segment of one of said blade members for movement therewith relative to said second segment of said one blade member.

11. An ink metering blade as set forth in claim 9 wherein said seal means includes a seal member having a narrow seal section disposed in the space between said first and second metering segments of one of said blade members and a wide mounting section connected with said first metering segment of said one blade member for movement therewith, said narrow seal section having a width sufficient to block a flow of ink through the space between said first and second metering segments of said one blade member.

12. An ink metering blade as set forth in claim 11 wherein said seal means further includes adhesive means disposed between said wide mounting section of said seal member and said first metering segment of said one blade member to interconnect said seal member and said first metering segment of said one blade member.

13. An ink metering blade as set forth in claim 11 wherein said seal means further includes adhesive means disposed between said narrow seal section of said seal member and said first metering segment of said one blade member to interconnect said seal member and said first metering segment of said one blade member.

14. An ink metering blade as set forth in claim 9 wherein the spaces between said metering segments of said second blade member are open, said seal means being disposed outside of the spaces between said metering segments of said second blade member.

15. An ink metering blade as set forth in claim 9 wherein said seal means fills the spaces between said metering segments of said second blade member to block a flow of ink through these spaces.

16. An ink metering blade as set forth in claim 9 wherein said seal means include a one-piece seal member having first and second narrow seal sections first and second wide mounting sections, and a connector section interconnecting said mounting sections, said first narrow seal section filling the space between said first and second metering segments of one of said blade members, said second narrow seal section filling the space between said first and second metering segments of the other one of said blade members, said first wide mounting section being connected with said first metering segment of said one blade member, said second wide mounting section being connected with said first metering segment of said other blade member and being disposed in abutting engagement with said first wide mounting section.

17. An ink metering blade as set forth in claim 9 wherein said seal means includes a first narrow seal section disposed in the space between said first and second metering segments of one of said blade members, a second narrow seal section disposed in the space between said first metering segment and a third one of the metering segments of said one blade member, said first and second narrow seal sections being interconnected by a wide section which is disposed between said first metering segments of said blade members.

18. An ink metering blade for controlling the thickness of an ink film on an ink fountain roll, said ink metering blade comprising a longitudinal blade member having a mounting portion extending in the longitudinal direction and a metering portion projecting from said mounting portion in a direction transverse to said longitudinal direction, said metering portion defining a metering edge, said metering portion including a plurality of metering segments arranged side-by-side along the longitudinal extent of said mounting portion and separated from each other by slots extending in said transverse direction from said metering edge to said mounting portion, said slots having a width enabling independent flexing of said metering segments, means for blocking ink flow through said slots and for enabling flexing of each of said metering segments without transmitting force to adjacent segments, said means comprising a plurality of members having a thickness corresponding substantially to the width of said slots, each of said plurality of members comprising a first portion projecting into one of said slots to fill said one slot and being disconnected from a metering segment which partially defines said one slot to enable the metering segments defining said one slot to move freely relative to each other, each of said plurality of members further includes a second portion extending transverse to said first portion and fixedly retained underneath one of said metering segments to fix said first portion to said one metering segment.

19. An ink metering blade as set forth in claim 18 wherein said members comprise tape members made of metal.

20. An ink metering blade as set forth in claim 18 wherein each of said members has an L-shape, said first portion being constituted by the short leg of said L-shape and said second portion being constituted by the long leg of said L-shape.

21. An ink metering blade as set forth in claim 18 wherein said member has a U-shape, one of the legs of said U-shape defining said first portion, the base of said U-shape defining said second portion, and the other leg of said U-shape defining another first portion of said member projecting into another slot.

22. An ink metering blade for controlling the thickness of an ink film on an ink fountain roll comprising a first longitudinal blade member defining a metering edge locatable adjacent the ink fountain roll, said first blade member comprising a plurality of metering segments arranged side-by-side along the longitudinal extent of said first blade member and separated from each other by slots extending from said metering edge transverse thereto, said slots having a width enabling independent flexing of said metering segments, said ink metering blade further comprising a plurality of first members having a thickness corresponding to the width of said slots and comprising first portions extending into respective slots and second portions extending transverse to said first portion and fixedly retained under respective ones of adjacent metering segments, and said ink metering blade comprising a second blade member located beneath said first blade member for fixedly retaining said second portions under said respective ones of adjacent metering segments, said second blade member being a segmented blade member similar to said first blade member, and said ink blade member comprising a plurality of second members similar to said first members and having their first portions extending into respective slots between segments of said second blade member, and their second portions retained between said first and second blade members in abutting relationship with first members along their second portions, the first portions of said first and second members extending in opposite directions.

23. An ink metering blade as set forth in claim 22 wherein said members have an L-shape, the short legs of which constitute said first portions and the long legs of which define said second portions.

* * * * *